US005088020A

United States Patent [19]

Nishida et al.

[11] Patent Number: 5,088,020

[45] Date of Patent: Feb. 11, 1992

[54] PIVOTAL MOVEMENT CONTROL DEVICE FOR BOOM-EQUIPPED WORKING MACHINE

[75] Inventors: Tetsuya Nishida; Yoshiyuki Katayama, both of Osaka, Japan

[73] Assignee: Kubota Ltd., Osaka, Japan

[21] Appl. No.: 393,669

[22] Filed: Aug. 14, 1989

[30] Foreign Application Priority Data

| | | | |
|---|---|---|---|
| Nov. 18, 1988 | [JP] | Japan | 63-150970[U] |
| Nov. 18, 1988 | [JP] | Japan | 63-293297 |
| Nov. 18, 1988 | [JP] | Japan | 63-293298 |
| Nov. 18, 1988 | [JP] | Japan | 63-293299 |

[51] Int. Cl.[5] ..... G05B 13/02

[52] U.S. Cl. ..... 364/160; 364/424.07; 364/167.01; 414/699

[58] Field of Search ..... 364/160, 167.01, 424.07; 414/687, 697, 698, 699, 711; 137/636.2, 625.46

[56] References Cited

U.S. PATENT DOCUMENTS

| | | | |
|---|---|---|---|
| 2,955,210 | 10/1960 | Dean et al. | 290/40 |
| 3,055,180 | 9/1962 | Kane | 60/53 |
| 3,490,606 | 1/1970 | Gordon | 212/66 |
| 3,698,580 | 10/1972 | Carlson et al. | 137/625.46 |
| 3,739,652 | 6/1973 | Caldwell et al. | 212/69 |
| 3,760,591 | 9/1973 | Gordon | 60/444 |
| 4,037,519 | 7/1977 | Miller et al. | 91/1 |
| 4,044,838 | 8/1977 | Wooldridge | 172/2 |
| 4,285,268 | 8/1981 | Deckler | 91/517 |
| 4,337,959 | 7/1982 | Bettin et al. | 280/43.23 |
| 4,389,153 | 6/1983 | Pedersen et al. | 414/695.5 |
| 4,393,607 | 7/1983 | Hirosawa et al. | 414/687 |
| 4,399,653 | 8/1983 | Pylat, Jr. | 60/327 |
| 4,419,040 | 12/1983 | Pedersen et al. | 414/687 |
| 4,552,503 | 11/1985 | Mouri et al. | 414/687 |
| 4,680,929 | 7/1987 | Mouri et al. | 60/368 |
| 4,863,337 | 9/1989 | Ishigura et al. | 414/699 |

FOREIGN PATENT DOCUMENTS 2022745 11/1971 Fed. Rep. of Germany .

*Primary Examiner*—Jerry Smith
*Assistant Examiner*—Paul Gordon

[57] ABSTRACT

Disclosed is a pivotal movement control device for a boom-equipped working machine provided with a pivotal movement control responsive to the inclined angle of a control lever and a position detector for detecting the moved position of a boom in a lateral direction. The device includes a changeover switch for changing between an automatic mode and a manual mode, an automatic target position stop control for storing a signal from the position detector as a target stop position when the changeover switch is changed from the manual mode to the automatic mode and pivotally moving the boom to the target stop position and stopping it there while reading a positional signal from the position, when the boom is at a position other than the target stop position and the control lever is operated to the side of the target stop position. The device also includes a manual control for controlling the boom according to a signal from the pivotal movement control when the control lever is operated in another manner and when the changeover switch is in the manual mode.

18 Claims, 10 Drawing Sheets

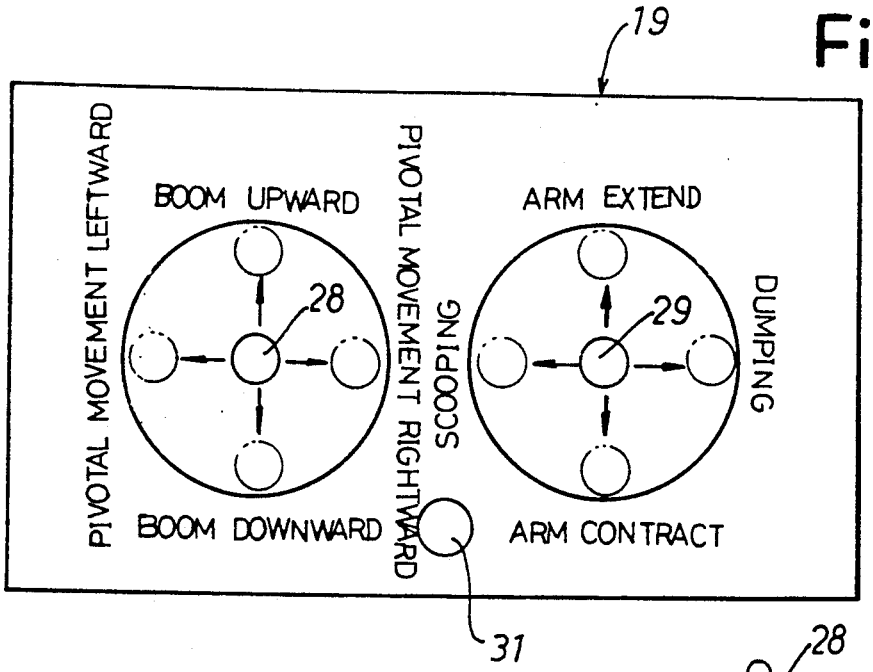
Fig. 6
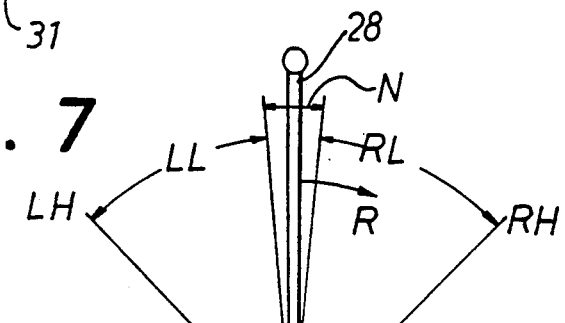
Fig. 7
Fig. 8
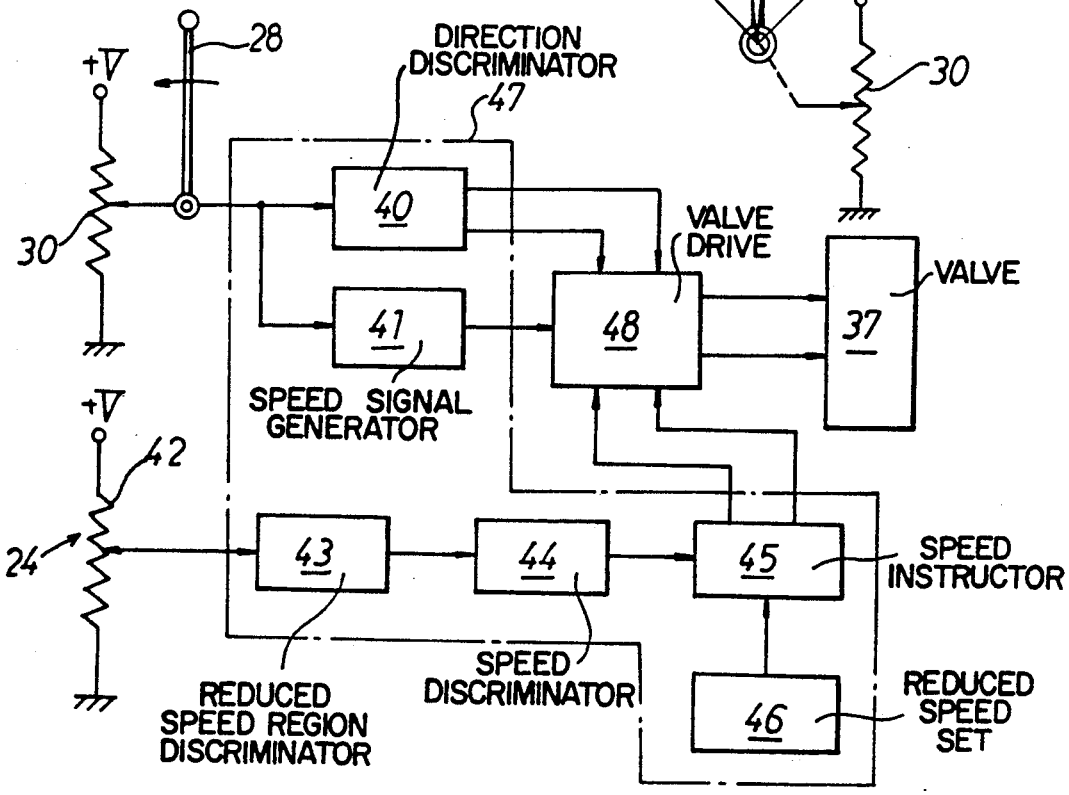

PIVOTAL MOVEMENT CONTROL DEVICE FOR BOOM-EQUIPPED WORKING MACHINE

FIELD OF THE INVENTION AND RELATED ART STATEMENT

The present invention relates to control systems for boom-equipped working machines such as backhoes.

Working machines such as backhoes have a boom equipped with a working implement at its forward end and pivoted to a vehicle body about a vertical axis for performing the contemplated work with the implement.

The backhoe comprises a machine frame attached to a vehicle body, a pivotal frame mounted on the machine frame and movable about a vertical axis by the extension or contraction of pivotal cylinders, a boom connected to the pivotal frame and upwardly or downwardly movable about a horizontal axis by the extension or contraction of a boom cylinder, a bucket angularly movably attached to an arm connected to the free end of the boom, and a control valve coupled to control levers and adapted to control the pivotal cylinders, the boom cylinder, an arm cylinder and a bucket cylinder.

When a ditch or the like is excavated with this kind of the backhoe, the boom must be frequently moved, for example, from the center of an excavating position in a lateral direction to a soil discharging position and then precisely positioned again at the excavating position.

Thus, a pivotal movement control device employing an automatic control system is devised, wherein when a boom is pivotally moved in a soil discharging direction, a manual control system using a control lever is employed and when the boom is returned to an excavating position after discharging soil, an automatic control system is employed to pivotally move the boom to a target stop position while detecting the moved position thereof by position detecting means and to automatically stop the boom when it reaches the target stop position.

This pivotal movement control device, however, has a drawback in that since a change between an automatic mode and a manual mode must be carried out using many switches. In particular, the automatic mode must be changed to the manual mode when the boom is moved to the soil discharging direction by a manual control after the boom is stopped at the excavating position and excavation is carried out. Likewise, when an automatic control is shifted to the manual control before the automatic control is finished, the mode must be also changed.

In the manual control, when the boom reaches the vicinity of the terminus position thereof in a lateral direction, an inclining angle of the control lever must be reduced to lower a pivotally moving speed of the boom since the control lever is operated laterally to control the pivotally moving speed of the boom in a lateral direction in proportion to the inclining angle of the control lever.

Therefore, when an operator makes a mistake in the operation of the control lever, the boom moves to the terminus point at a high speed and violently collides against stoppers at the right and left ends, with the result that the shock of the collision causes the stop position of a vehicle body to dislocate during work, and the boom, an arm and a bucket may collide against the cylinder of outriggers at the opposite sides and damage it depending on the attitude thereof.

Further, when the moved position of the boom is sensed by the position detecting means, the position detecting means is disposed on one of a pivotal base for supporting the boom or a fixed side and the detecting arm of the position detecting means is associated with a control arm on the other side.

Since the pivotal base repeats pivotal movement in a lateral direction during work at all times, however, when the portion where the detecting arm is engaged with the control arm includes lateral play an error corresponding to an amount of play is produced in a value detected by the position detecting means and thus the moved position of the boom cannot be correctly detected. Then, this arrangement has a drawback in that the boom cannot be stopped at a target stop position with high accuracy even if it is stopped there while the moved position thereof is detected by the position detecting means. In addition, even if the amount of play is negligible at first, play and jarring are caused by wearing and the like when the arrangement is used for a long time and a stopping accuracy is inevitably deteriorated.

Further, this kind of the pivotal movement control device includes such an arrangement that a potentiometer is operated by the lateral movement of the control lever, an output voltage therefrom is compared with a reference value to determine a direction of pivotal movement and to generate a pivotal moving speed signal proportional to the absolute value of a difference between the output voltage and the reference value.

With this arrangement, an instruction for the direction of pivotal movement and an instruction for a pivotally moving speed can be provided simultaneously by a single potentiometer.

Since, however, an abnormal state of the potentiometer cannot be conventionally detected, an uncontrollable state of the potentiometer encountered when it is short-circuited or broken cannot be securely detected. In addition, when the instruction for pivotally moving speed is given based on the output voltage from the potentiometer, as described above, it may generate an output voltage having an effect to give an instruction for a high pivotally moving speed, as when the control lever is at the maximum inclined angle thereof, depending on failure of the potentiometer and then a backhoe may be pivotally moved abruptly at a high speed while being operated.

OBJECTS AND SUMMARY OF THE INVENTION

The present invention has been accomplished in order to overcome the foregoing drawbacks.

More specifically, a first object of the invention is to provide a pivotal movement control device capable of being simply operated by a control lever without requiring a change between an automatic mode and a manual mode effected by a changeover switch for thereby greatly improving operability, making the operation thereof easier than a conventional device and improving working efficiency and safety.

To fulfill this first object, the present invention provides a pivotal movement control device for a boom-equipped working machine including pivotal movement instructing means 30 in association with the inclined angle of a control lever 28 and position detecting means 24 for detecting the moved position of a boom 16 in a lateral direction, which comprises a changeover switch 31 for changing between an automatic automatic mode and a manual mode, automatic target position stop control means 34 for storing a signal from the position detecting means 24 as a target stop position B when the changeover switch 31 is changed from the manual mode to the automatic mode and pivotally moving the boom 16 to the target stop position B and stopping it there while reading a positional signal from the position detecting means 24 when the boom 16 is at a position other than the target stop position B and the control lever 28 is operated to the side of the target stop position B, and manual control means 35 for controlling the boom 16 according to a signal from the pivotal movement instruction means 30 when the control lever 28 is in operations other than the above operation and when the changeover switch 31 is in the manual mode.

A second object of the invention is to provide a pivotal movement control device capable of being easily operated and automatically reducing a speed of a boom when the boom, enters into a speed reducing region in the vicinity of a terminus of boom movement even if a large inclined angle of the control lever is held for thereby making the operation of the device easy without causing the possibility that a stop position is dislocated like a conventional device, the cylinder of outriggers is damaged and the like.

To fulfill this second object, the present invention pivotal movement control device for a boom-equipped working machine including pivotal movement instructing means 30 in association with the inclined angle of a control lever 28 and position detecting means 24 for detecting the moved positions of a boom 16 in a lateral direction and controlling the boom 16 according to the inclined angle of the control lever 28, which comprises speed reducing region discriminating means 43 for discriminating whether the boom 16 is positioned in speed reducing regions H in the vicinity of terminus points F based on a signal from the position detecting means 24 when the boom 16 is pivotally moved to lateral terminus points, and speed instruction means 45 for generating a speed reducing instruction when a pivotally moving speed c of the boom 16 is greater than an instructed speed reducing speed d.

A third object of the invention is provide a pivotal movement control device capable of securely and accurately detecting the moved position of the boom by position detecting means regardless of play, wearing and the like of a portion where a detecting arm is engaged with a control arm for thereby stopping the boom with high accuracy.

To fulfill this third object, the present invention provides a pivotal movement control device for a boom-equipped working machine including a pivotal base 15 for supporting a boom 16, the pivotal base 15 being pivotally movable in a lateral direction and a position detecting means 24 for detecting the moved position of the pivotal base 15, storing a signal from position detecting means 24 as a target stop position and stopping the pivotal base 15 at the target stop position while detecting the present position of the pivotal base 15 by the position detecting means 24, which comprises the position detecting means 24 disposed on one of the pivotal base 15 and a fixed side, a control lever 55 disposed on the other of the pivotal base 15 and the fixed side for operating a detecting lever 50 of the position detecting means 24 in association with the pivotal base 15, and a spring 57 urging the position detecting lever 50 and the control lever 55 into engagement on the same side at all times.

A fourth object of the invention is to provide a pivotal movement control device capable of detecting an abnormal state of a potentiometer used for controlling the device based on a control signal therefrom by detecting an output voltage generated from the potentiometer having a value beyond the compass of the upper and lower limits of the control signal because the potentiometer is short-circuited or broken.

To fulfill this fourth object, the present invention provides a pivotal movement control device for a boom-equipped working machine provided with a potentiometer 30 for taking out a control signal, upper limit setting means 65 and lower limit value setting means 66 for setting an upper limit value and a lower limit value of the control signal, and upper limit value discriminating means 63 and lower limit discriminating means 64 for comparing a voltage output from said potentiometer 30 with the upper and lower limit values and outputting an abnormal signal when the output voltage is beyond the compass of the upper and lower limit values of the control signal.

BRIEF DESCRIPTION OF THE DRAWINGS

FIGS. 1 through 7 show a first embodiment of the invention;

FIG. 1 is a block diagram of a control system;

FIG. 2 is a flowchart of the operation of the control system;

FIG. 3 is an explanatory diagram of the operation of an automatic target position stop control;

FIG. 4 is a side view of a tractor as a whole;

FIG. 5 is a plan view in section of a pivotal base;

FIG. 6 is a diagram of the arrangement of a control lever;

FIG. 7 is an explanatory diagram of a control region of the control lever;

FIGS. 8 through 10 show a second embodiment of the invention;

FIG. 8 is a block diagram of a control system;

FIG. 9 is a flowchart of the operation of the control system;

FIG. 10 is an explanatory diagram of a pivotally moving region;

FIG. 11 is a plan view of a detecting unit,

FIG. 12 is a side view in section of the detecting unit;

FIG. 13 is an explanatory diagram of the operation of the detecting unit;

FIG. 14 is a is a block diagram of a control system;

DESCRIPTION OF THE PREFERRED EMBODIMENTS

The present invention will be described below in detail with reference to the illustrated embodiments FIGS. 1 through 7 show a first embodiment of the invention which comprises a tractor, and a front loader and a backhoe attached to the front and rear portions of the tractor, respectively.

Figure 4:
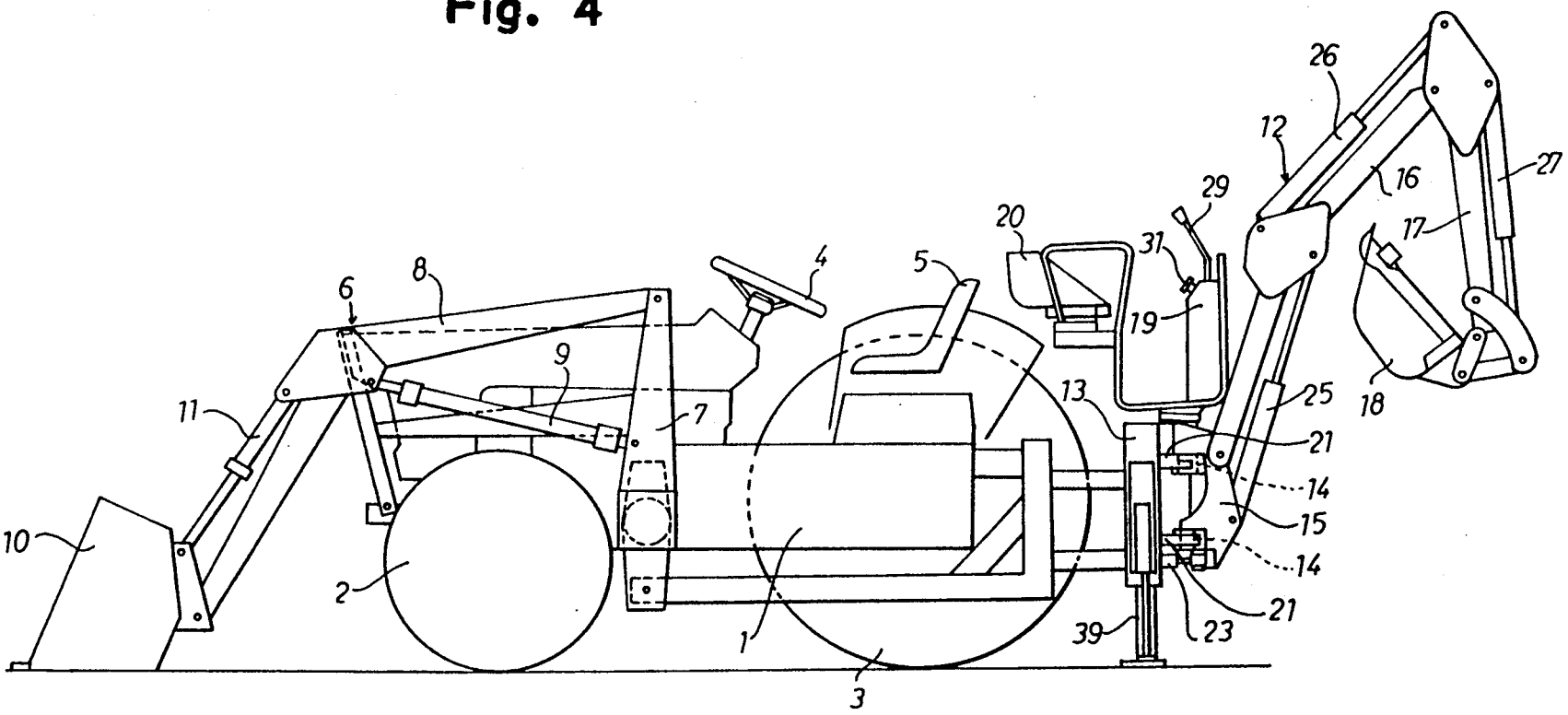

Referring to FIG. 4, the tractor has a body 1, front wheels 2, rear wheels 3, a steering wheel 4 and a driver's seat 5.

Indicated at 6 is the front loader attached to the front end of the tractor body 1 and comprising masts 7 attached to the respective lateral sides of the body 1, a boom 8 pivotally supported by the upper ends of the masts 7 and movable upward and downward, a boom cylinder 9 for raising and lowering the boom 8, a bucket 10 pivoted to the forward end of the boom 8, and a bucket cylinder 11 for moving the bucket 10.

Figure 5:
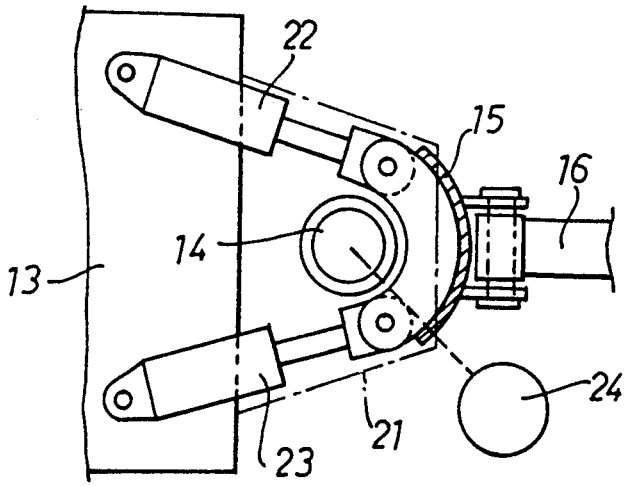

Indicated at 12 is the backhoe attached to the rear end of the tractor body 1. The backhoe 12 comprises a machine frame 13 attached to the tractor body 1, a pivotal base 15 supported by the machine frame 13 and swingable about vertical pivots 14, a boom 16 pivoted to the pivotal base 15 and movable upward and downward about a lateral axis, an arm 17 pivoted to the distal end of the boom 16 and movable upward and downward, a bucket 18 pivoted to the distal end of the arm 17, a control box 19 mounted on the pivotal base 15, and an operator's seat 20. With reference to FIG. 5, the pivotal base 15 is supported by the vertical pivots 14 on a pair of upper and lower brackets 21 projecting rearward from the machine frame 13 and is pivotally moved by a pair of opposed base cylinders 22 and 23 connected between the machine frame 13 and the pivotal base 15 and positioned close to the lower bracket 21. The pivotal base 15 is provided with position detecting means such as a potentiometer for detecting the moved position of the base 15. The boom 16 and the arm 17 are moved upward and downward by a boom cylinder 25 and an arm cylinder 26, respectively. The bucket 18 is pivotally moved by a bucket cylinder 27. The machine frame 13 is provided with a pair of outriggers 39 at its respective ends.

With reference to FIG. 6, a control box 19 is provided on its upper side with two control levers 28, 29 disposed laterally which are pivotally movable forward and rearward, and rightward and leftward. The control lever 28 moves the pivotal base 15 rightward and leftward when shifted rightward and leftward and moves the boom 16 upward and downward when shifted forward and rearward. The control lever 29 causes the bucket 18 to perform a scooping or dumping action when shifted leftward or rightward and causes the arm to extend and contract when shifted forward and rearward.

With reference to FIG. 7, the control lever 28 is coupled with the potentiometer 30 comprising pivotal movement instruction means and can be operated to any inclined angle in a lateral direction between a neutral region N and high speed positions LH and RH at the opposite ends. Further, an instruction signal from the potentiometer 30 is continuously variable in the low speed regions LL and RL between the neutral region N and the high speed positions LH and RH.

Figure 1:
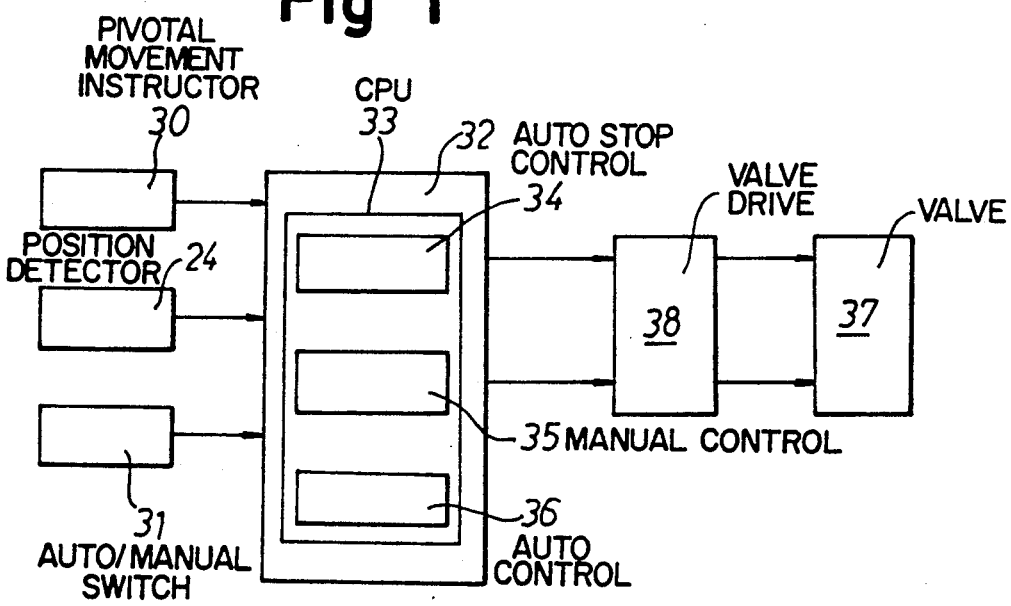

FIG. 1 shows the main portion of the pivotal movement control device, wherein 31 indicates a changeover switch for automatic and manual modes composed of a momentary type push button switch and disposed on the upper side of the control box 19. Indicated at 32 is a microcomputer in charge of control processings comprising a central processing unit 33, ROM, RAM and the like, and the central processing unit also includes automatic target position stop control means 34, manual control means 35, and automatic return control means 36. The automatic target position stop control means 34 stores a signal from the position detecting means 24 as a target stop position B when the changeover switch 31 is changed from the manual mode to the automatic mode and pivotally moves the boom 16 to the target stop position B and stops it there while reading a positional signal from the position detecting means 24, only when the boom 16 is at a position other than the target stop position B and the control lever 28 is operated to the side of the target stop position B. The manual control means 35 controls the boom 16 according to a signal from the instruction means 30 when the changeover switch 31 is switched to the manual mode and when the control lever 28 is in operations other than the above operation. The automatic return control means 36 automatically returns the boom 16 to the target stop position B under the automatic mode control when the boom 16 overruns the target stop position B by inertia. Indicated at 37 is a flow rate proportional type electromagnetic valve for the cylinder 23 for pivotal movement. Indicated at 38 is drive means for the electromagnetic valve 37 incorporating a duty control type PWM control unit for controlling a pivotally moving speed of the boom 16.

Figure 2:
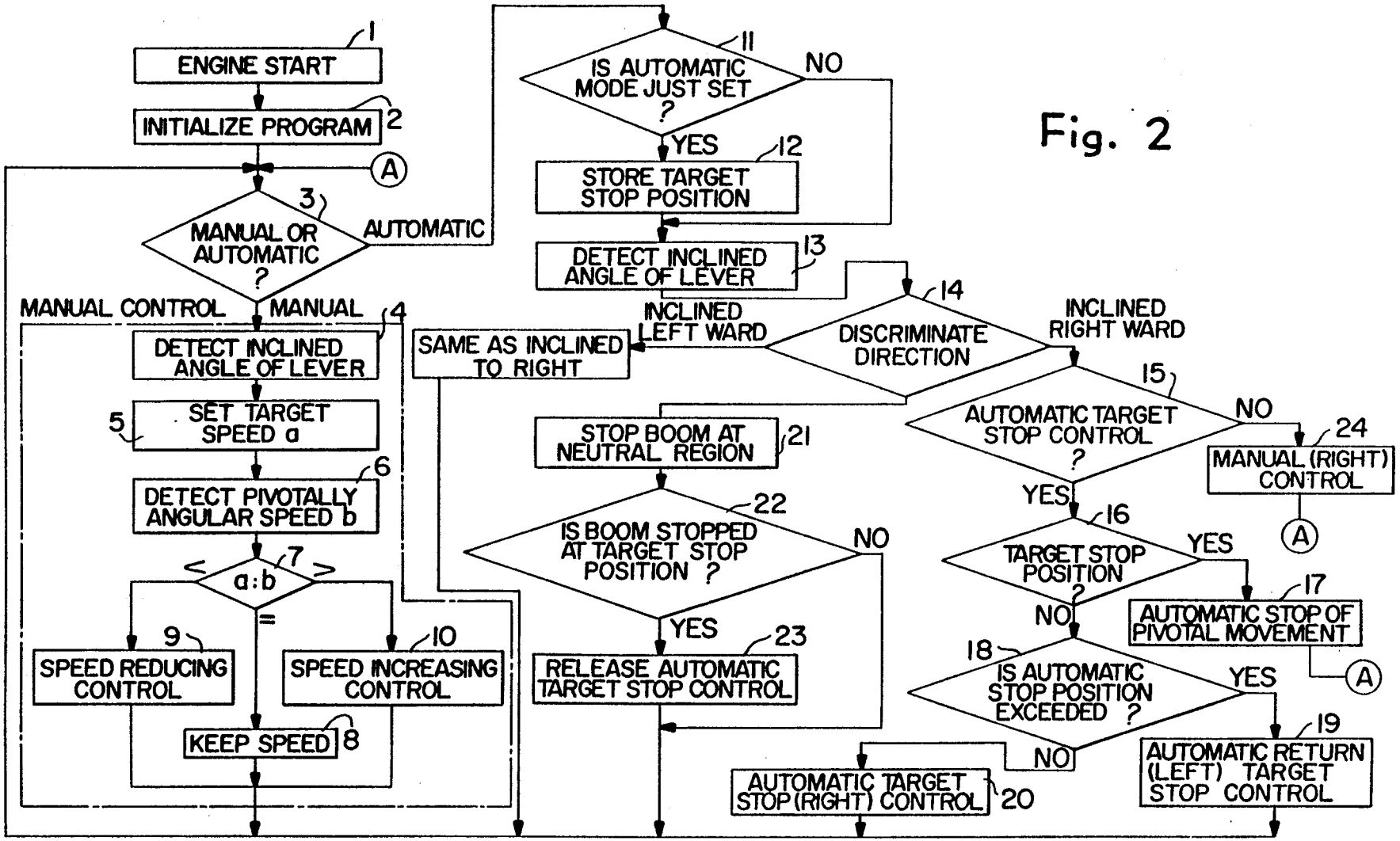

Next, operation of a pivotal movement control of the backhoe will be described with reference to a flowchart of FIG. 2.

First, the engine of the tractor is started (step 1), and then a program is initialized (step 2). When the manual mode is to be employed and the changeover switch 31 is changed to the manual mode, the central processing unit (referred to as a CPU, hereinafter) of the microcomputer 32 determines whether the manual mode is employed or not (step 3), and the flow continues employing of the manual control means 35.

Then, the control lever 28 is inclined either rightward or leftward to operate the potentiometer 30 and an inclined angle of the control lever 28 input from the potentiometer 30 is detected (step 4) to set the target speed a thereof (step 5). Next, the electromagnetic valve 37 is changed by the drive means 38 so that the pivotal base 15 and the boom 16 are pivotally moved about the vertical pivots 14 by the extension or contraction of the base cylinder 23. At first, the boom 16 is pivotally moved in the direction toward which the control lever 28 is inclined at a speed proportional to the inclined angle thereof. More specifically, since a positional signal from the position detecting means 24 varies in proportion to the pivotally moving speed of the boom 16 when it begins to be pivotally moved, an angular speed of pivotal movement b is detected based, on the rate of change thereof (step 6). Then, it is determined which of the target speed a and the angular speed of pivotal movement is larger (step 7) by comparing them. When the target speed is equal to the angular speed, the angular speed is maintained (step 8), when the target speed a is smaller than the angular speed, a speed reducing control is effected (step 9) and when the target speed a is larger than the angular speed, an speed increasing control is effected (step 10).

When the control lever 28 is returned to the neutral region N after the boom 16 is pivotally moved to a soil discharging position or any other prescribed position, the inclined angle becomes zero (step 4) and the target speed a becomes zero (step 5) so that the target speed a is smaller than the angular speed of pivotal movement b and the boom 16 is stopped at the position by the speed reducing control (steps 6, 7 and 9).

When the changeover switch 31 is changed to the automatic mode, the CPU 33 discriminates the automatic mode (step 3) and the manual mode by the manual control means 35 is changed to the automatic mode by the automatic target position stop control means 34. At the time, when the changeover switch 31 is changed to the automatic mode after the boom 16 is positioned at an excavating position at the lateral center by the manual mode, as described above, it is determined whether the automatic mode is just set (step 11). When it is just after the change to the automatic mode is effected, a positional signal from the position detecting means 24 is stored as the target stop position B (step 12). Next, the inclined angle of the control lever 28 is detected and read (step 13) and the direction in which the control lever 28 is operated is determined (step 14).

Figure 3:
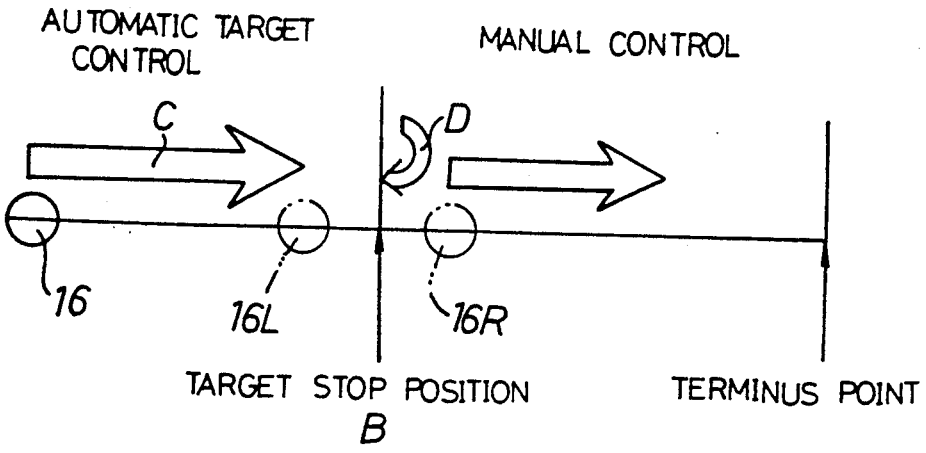

Assuming that the boom 16 is at a position other than the target stop position B, e.g., at a soil discharging position on the left hand side, as shown in FIG. 3 and the control lever 28 is inclined at the position rightward with respect to the target stop position B (in the direction shown by an arrow R in FIG. 7). Since it is determined that the control lever 28 is inclined rightward at step 14 at the time, it is also determined whether the inclined direction is directed to the target stop position B, i.e., whether the automatic target position control is effected (step 15) to automatically pivotally move the boom 16 to the target stop position B (to a direction C in FIG. 3). The moved position of the boom 16 is read from the position detecting means 24 during this pivotal movement, and when the target stop position B is reached, this is determined and the boom 16 is automatically stopped (steps 16 and 17). More specifically, when the control lever 28 is inclined to the target stop position B side, the boom 16 is pivotally moved to the target stop position B and automatically stopped at the target stop position in the state of the control lever 28 as it is.

When the boom 16 overruns the target stop position B by inertia or the like while pivotally moved to the target stop position B, this is determined by reading a positional signal from the position detecting means 24 (step 18) and the control is changed to an automatic return (left) target stop control (step 19) to automatically return the boom 16 to the target stop position B as shown by an arrow D in FIG. 3, and then the flow returns to step 3. When the boom 16 does not overrun the target stop position B, the automatic target stop control is continued (step 20), and then the flow returns to step 3.

When the control lever 28 is returned to the neutral region N in the automatic mode, this is determined at step 14 and the pivotal movement of the boom 16 is stopped (step 21). Then, it is determined whether the stop position at this time is the target stop position B (step 22). When it is the target stop position B, the automatic target stop control is released (step 23) and the flow returns to step 3. Therefore, the control lever 28 may be returned to the neutral region N anytime after the boom 16 is stopped at the target stop position B and it is not necessary to return it as soon as the boom 16 is stopped. When the control lever 28 is returned to the neutral region and the position where the boom 16 is stopped is in front of the target stop position B as shown in a virtual line 16L in FIG. 3, the flow returns to step 3 from step 22 and the automatic target stop control is not released.

When the boom 16 is stopped, for example, at the right side of the target stop position B as shown by a virtual line 16R even after the target stop position B is stored and the control lever 28 is inclined toward a direction opposite to the target stop position B, i.e., rightward at this position, the automatic, target position stop control is not used, and this is determined at step 15 and the flow shifts to a manual (right) control by the manual control means 35 (step 24). Therefore, the flow can also shift to the manual control by operating the control lever 28 in the automatic mode.

Figure 9:
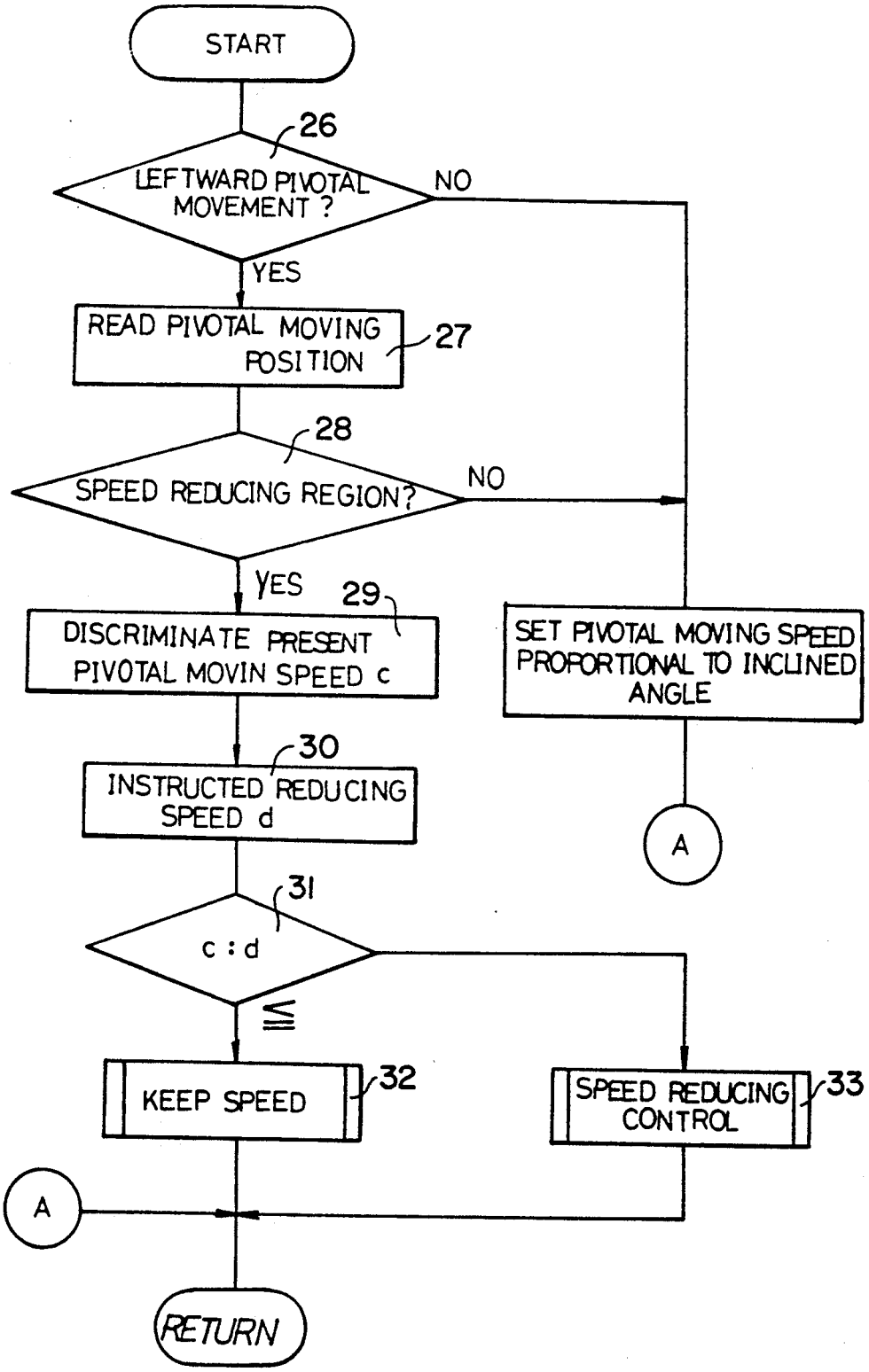
Figure 10:
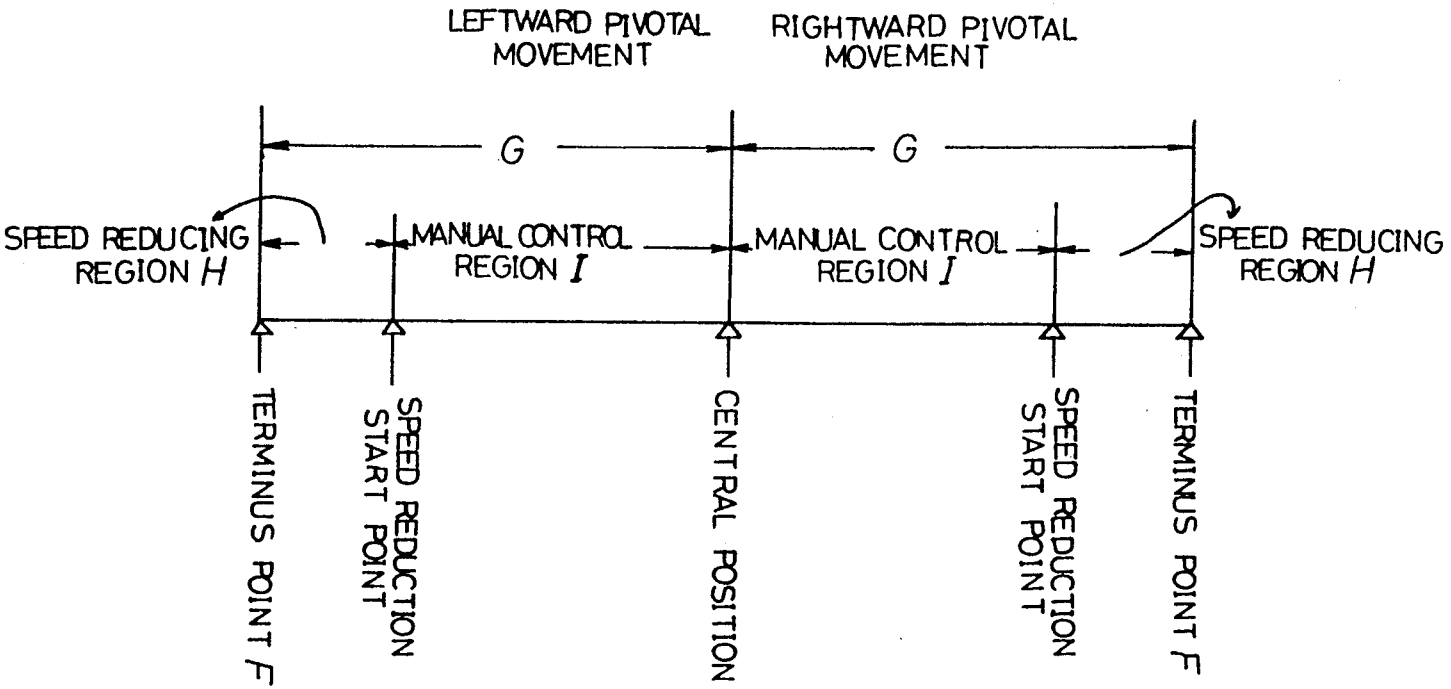

FIGS. 8 through 10 show a second embodiment of the invention.

With reference to FIG. 8, a potentiometer 30 is coupled with direction discriminating means 40 and speed signal generating means 41. The direction discriminating means 40 compares an output voltage from the potentiometer 30 with a reference voltage to determine a pivotally moving direction and the speed signal generating means 41 generates a speed signal proportional to the inclined angle of the control lever 28 based on the output voltage.

A position detecting means 24 comprises a potentiometer 42 and the like and the potentiometer 42 is coupled with speed reducing region discriminating means 43, speed discriminating means 44, speed instruction means 45 and the like. With reference to FIG. 10, the speed reducing region discriminating means 43 determines the prescribed speed reducing regions H of pivotally moving regions G of from the central position E to terminus positions F at the opposite ends where a pivotal base 15 is pivotally moved based on the output from the potentiometer 42. The speed discriminating means 44 determines present pivotally moving speed c when the boom 16 is pivotally moved based on a change in the output from the potentiometer 42. The speed instruction means 45 compares the present pivotally moving speed c from the speed discriminating means 44 with an instructed reducing speed d set in instructed reducing speed setting means 46. The speed instruction means 45 generates a speed reduction keeping instruction when the pivotally moving speed c is equal to or less than the instructed reducing speed d and generates a speed reduction instruction to reduce the speed to a given speed when the pivotally moving speed c is greater than the instructed speed reduction speed d. Note, these various means 40, 41, 43, 45 and 46 comprise the central processing unit of a microcomputer 47 and the like. Indicated at 48 is a drive circuit for selectively driving a pair of solenoids of an electromagnetic valve 37 and incorporates a control unit for reducing the speed to the given value when a speed reduction is instructed.

Next, operation of the above arrangement will be described with reference to a flowchart in FIG. 9.

When the pivotal base 15 at the central position E is to be pivotally moved leftward, control lever 28 is inclined leftward to operate the potentiometer 30, and then the direction discriminating unit 40 discriminates the pivotally moving direction (step 26). Since the speed signal generating unit 41 generates a speed signal proportional to the inclined angle of the control lever 28, the electromagnetic valve 37 is driven by the drive circuit 48 and the pivotal base 15 is pivotally moved leftward at a speed proportional to the inclined angle by the extension or contraction of a pair of opposite cylinders 23. On the other hand, since this is a leftward pivotal movement toward the terminus position F from the central position E, a speed reducing region discriminating means 43 sequentially reads the moved position detected by the position detecting means 24 (step 27) and the speed reducing region determines means 43 discriminates whether the moved position of the pivotal base 15 is in a manual control region I or in an speed reducing region H (step 28). When the pivotal base 15 reaches the vicinity of the terminus position and enters a speed reducing region H, the speed discriminating means 44 determines the present pivotally moving speed c (step 29) and further reads the instructed reducing speed d from the instructed reducing speed setting means 46 (step 30). Then, the speed instruction means 45 compares the speed c with the speed d (step 31). When the present speed c is a low speed which is equal to or less than the instructed speed d, the speed instruction means 45 generates a speed keeping instruction (step 32) so that the pivotal base 15 is pivotally moved to the terminus position at this speed. When the present speed c is greater than the instructed speed d, the speed instruction means 45 generates a speed reducing instruction (step 33) so that the drive circuit 48 is operated to reduce the pivotally moving speed to a given speed equal to or less than the instructed speed d. Therefore, since the pivotally moving speed is automatically reduced when the boom 16 enters the speed reducing region H even if the control lever 28 has a large inclined angle, the pivotal base 15 is stopped by being held in abutment against a stopper at the terminus position at a low speed so that there is no possibility that a position where the pivotal base 15 is stopped is dislocated or the cylinder of outriggers is damaged as is conventionally encountered and operation is made easier.

Note that the respective control means may be composed of hardware.

FIGS. 11 through 14 show a third example of the invention.

Figure 11:
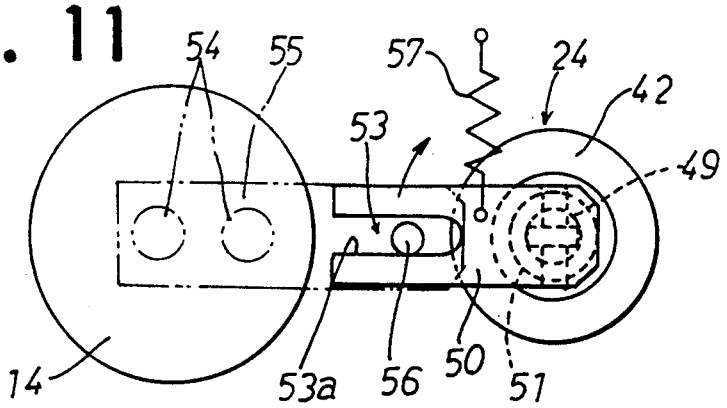
FIGS. 11 through 14 show a third embodiment of the invention.
Figure 12:
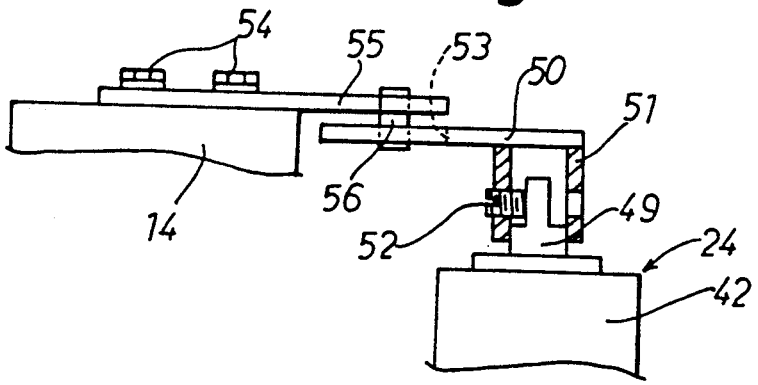
Figure 13:
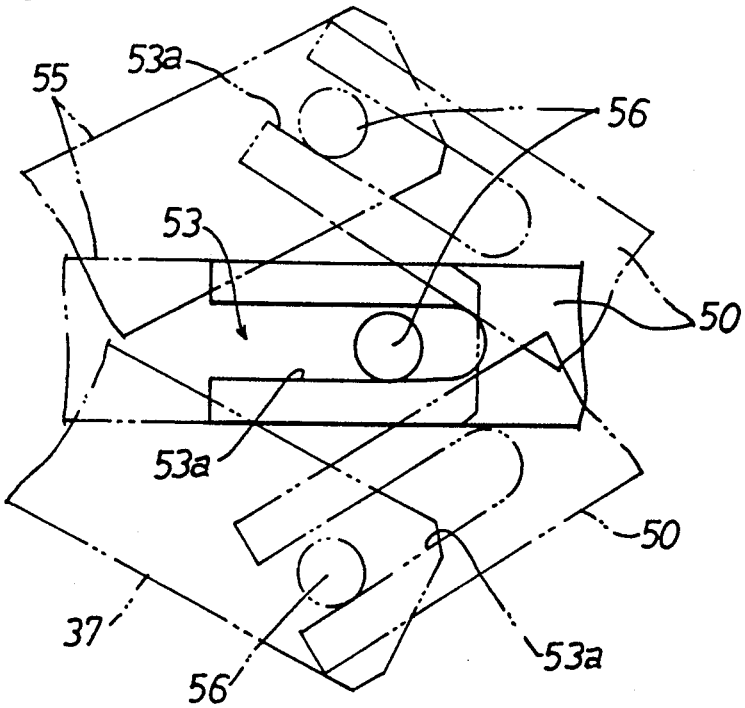

With reference to FIGS. 11 and 12, position detecting means 24 comprises a potentiometer 42 having a pivotal shaft 49. A boss portion of a detecting lever 50 is placed over the pivotal shaft 49 and fixed thereto by a screw 52. The detecting lever 50 projects to the side of a vertical pivot 14 and an engaging recess 53 is defined to the projected portion, while a control lever 55 is fixed to the side of the vertical pivot 14 by bolts 54 or the like. An engaging pin 56 at the distal end of the control lever 55 is inserted into the engaging recess 53 in such a manner that it enables both the levers 55 and 50 to be relatively turned. With reference to FIG. 11, the detecting lever 50 is urged by a spring 57 to cause the engaging pin 56 to be engaged with a side 53*a* of the engaging recess 53. Note that although the spring 57 may extend from the detecting lever 50 externally of the position detecting means 24 as shown in the figure, it may be spirally accommodated in the position detecting means 24.

Figure 14:
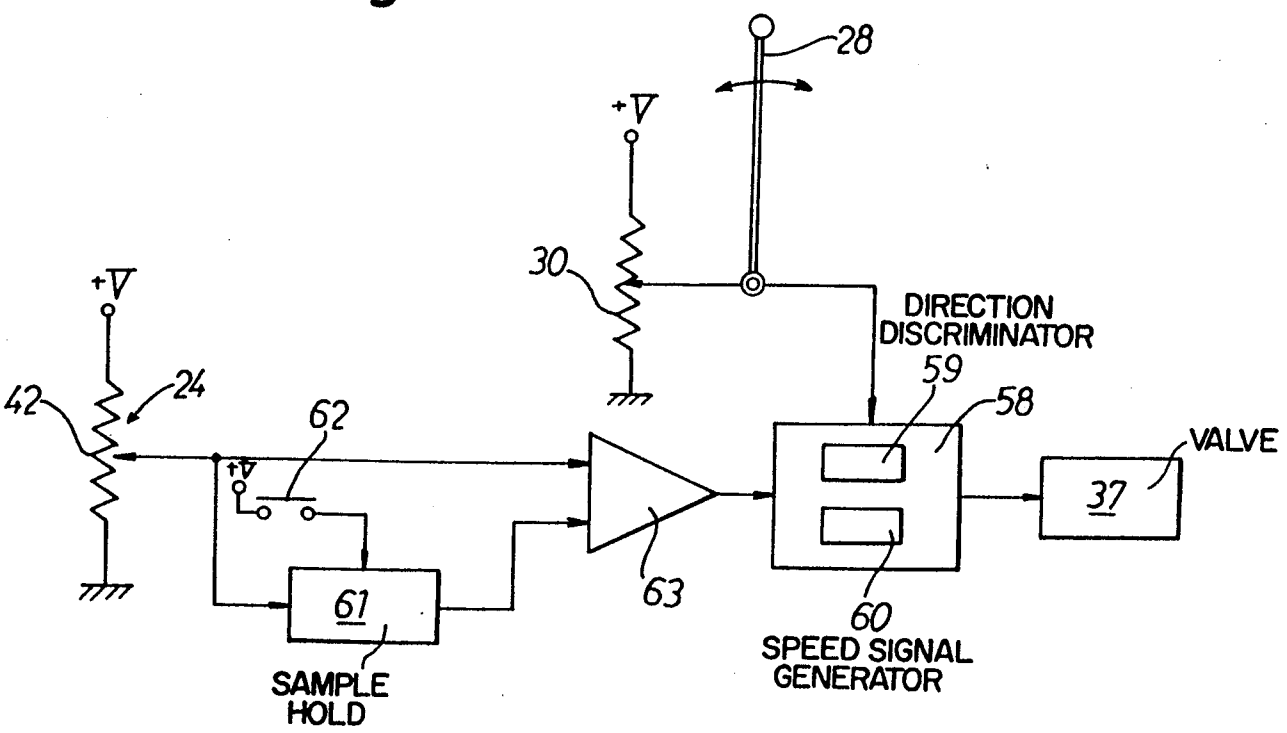

FIG. 14 shows a control system, wherein 58 indicates a control circuit for controlling an electromagnetic valve 37, including a direction discriminating unit 59 for determining the pivotally moving direction, based on an instructing signal from a potentiometer 30, and a speed signal generating unit 60 for generating a speed signal proportional to the instructing signal. Indicated at 61 is a sample hold circuit as storing means for storing a signal from the potentiometer 42 of the position detecting means 24 as a target stop position when a switch 62 is depressed. Indicated at 63 is a comparison circuit for automatic stop for comparing the present position of a pivotal base 15 detected by the position detecting means 24 with a target stop position from the sample hold circuit 61 when the pivotal base 15 is stopped and applying a stop instruction to the control circuit 58 when the former position coincides with the latter position.

With the arrangement as described above, when a ditch or the like is excavated, the pivotal base 15 is pivotally moved and stopped to locate a bucket at a position to be excavated and then the switch 62 is depressed. Since the position detecting means 24 detects the moved position of the pivotal base 15 at the time, the signal therefrom is stored in the sample hold circuit 61 as a target stop position.

When soil and sand in a bucket 18 are discharged sideward and a control lever 28 is inclined either rightward or leftward, the pivotal base 15 is pivotally moved in a direction toward which the control lever 28 is inclined at a pivotal moving speed proportional to the inclined angle. The control lever 28 is returned to a neutral region at a suitable soil discharging position to stop the pivotal base 15 and then the soil and sand are discharged.

After the soil is discharged, the pivotal base 15 is pivotally moved in an opposite direction to return to the target stop position and is automatically stopped there to located the bucket 10 at a prescribed excavating position. When the control lever 28 is inclined in the return direction, the pivotal base 15 begins to be pivotally moved toward the target stop position at a speed proportional to the inclined angle thereof. During this movement, the position detecting means 24 detects the present moved position of the pivotal base 15 and a comparison circuit 63 compares the moved position with the target stop position. Since the control circuit 58 outputs a stop instruction when the former coincides with the latter, the pivotal base 15 is automatically stopped at the target stop position.

Since an urging force of a spring 57 is applied to the position detecting lever 50 at all times during this operation and the engaging pin 56 is engaged with the side 53*a* of the engaging recess 53, the engaging relationship is not varied even if the pivotal base 15 is moved either rightward or leftward so that problems such as the stop position being dislocated by play or jarring and the like do not arise. In addition, even if wear and the like occurs to the engaging portion, the jarring due to the wear does not become a problem. In particular, since the bucket 18 is located at the excavating position and then a signal at the time from the position detecting means 24 is stored as the target stop position, a change in a relative angle between the detecting lever 50 and the control lever 55, if any, does not adversely affect stopping accuracy and any dispersion of the stopping accuracy is not caused by deterioration with age.

Note that the engaging pin 56 and the engaging recess 53 may be provided reversely. In addition, the position detecting lever 50 may be fixed to a pivotal shaft 49.

Figure 15:
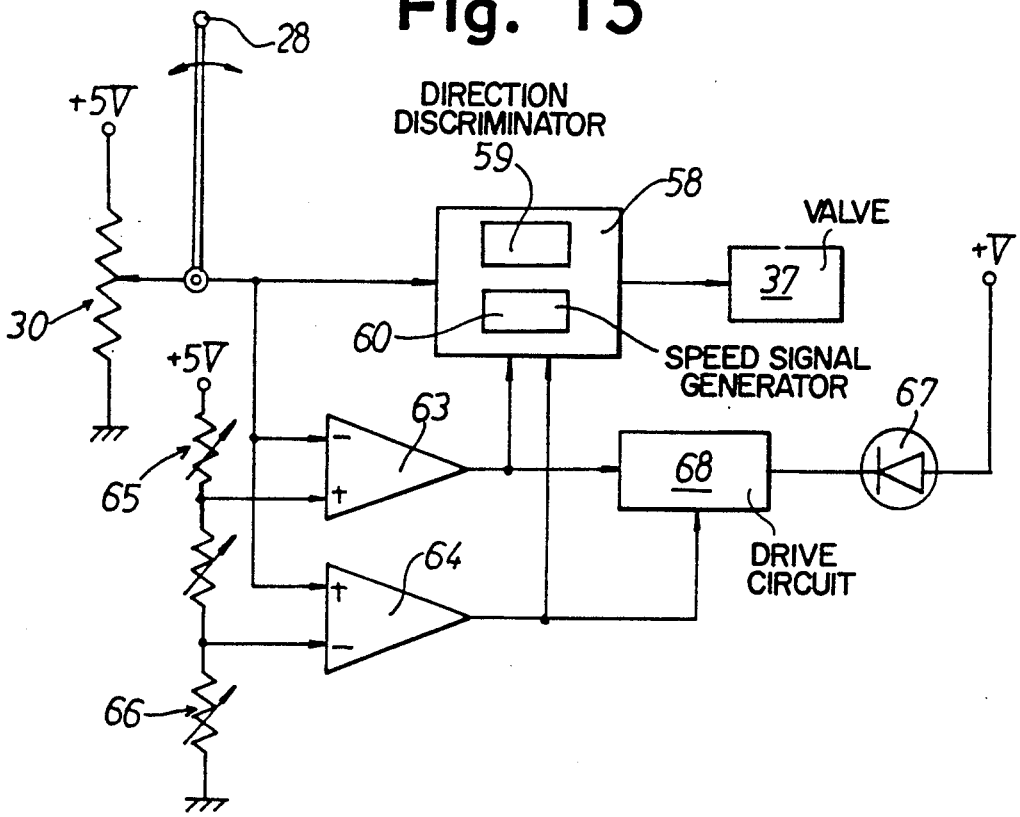
FIG. 15 is a block diagram of a control system showing a fourth embodiment of the invention.
Figure 16:
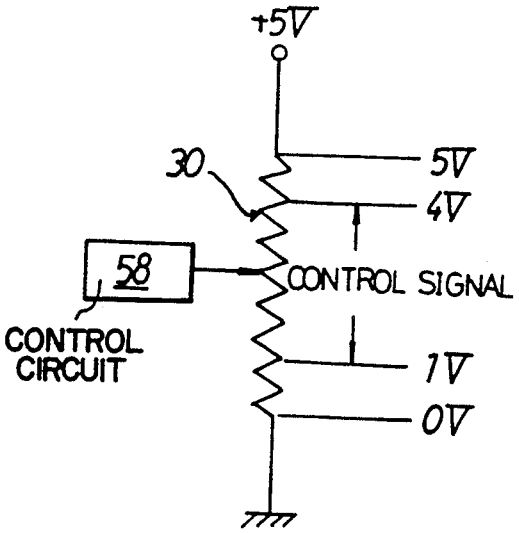
FIG. 16 is an explanatory diagram of the operation of the control system.

FIGS. 15 and 16 show a fourth embodiment of the invention.

With reference to FIG. 15, a voltage from a power supply of, for example, +5 V is imposed on a potentiometer 30 coupled with a control lever 28. A control circuit 58 includes direction discriminating means 59 and speed signal generating means 60. The direction discriminating means 59 compares an output voltage, i.e., a control signal from the potentiometer 30 with a reference voltage (e.g., 2.5 V) to discriminate a direction in which the pivotal base 15 is pivotally moved based on the result of the comparison and generates a speed signal proportional to an absolute value of a difference between the output from the speed signal generating means 60 and the reference value.

The output voltage from the potentiometer 30 is applied to the upper and lower limit discriminating means 63 and 64, and upper and lower limit values set by upper and lower limit value setting means 65 and 66 are applied to the upper and lower limit value discriminating means 63 and 64. The upper and lower limit value setting means 65 and 66 comprise variable resistors, and as shown in FIG. 16, the upper limit value (e.g., +4 V) is set by the upper limit value setting means 65 and the lower limit value (e.g., +1 V) is set by the lower limit value setting means 66, respectively. Therefore, a range of 1–4 V of a full output range of 0–5 V from the potentiometer 30 is used as the control signal. The upper and lower limit value discriminating means 63 and 64 comprise comparison circuits, respectively. The upper limit value discriminating means 63 outputs an abnormal signal when the output voltage is greater than the upper limit value and the lower limit value discriminating means 64 outputs an abnormal signal when the output voltage is smaller than the lower limit value. The abnormal signals cause the operation of the control circuit 58 to stop, and these signals applied to the drive circuit 68 of a light emitting diode 67. The light emitting diode 67 is an example of alarm means and the abnormal signal applied to the drive circuit 68 causes the light emitting diode 67 to blink to issue an alarm. Note that two abnormal signals may be applied to the drive circuit 68, wherein one of them is used to blink the light emitting diode 67 and the other is used to light the light emitting diode 67 continuously.

With the above arrangement, when the control lever 28 is operated rightward and leftward, the pivotal base 15 is pivotally moved about base pivots 14. The potentiometer 30 is operated in association with the control lever 28 to output a control signal within +1 to 4 V so that the direction discriminating means 59 and the speed signal generating means 60 of the control circuit 58 are operated to pivotally move the pivotal base 15 through a base cylinder 23.

When the potentiometer 30 is short-circuited and an output voltage of +5 V is generated, for example, the upper limit discriminating means 63 issues an abnormal signal since the output voltage exceeds the voltage set by the upper limit value setting means 65. Operation of the control circuit then stops, and simultaneously the drive circuit 68 causes light emitting diode 67 to blink and warn the operator of an abnormality in the potentiometer.

What is claimed is:

1. A pivotal movement control device for a boom-equipped working machine comprising (1) a control lever which is movable between inclined positions on either side of a neutral region, (2) pivotal movement instructing means for controlling a pivotal movement of a boom in response to an inclined position of said control lever and (3) position detecting means for detecting the pivotal position of the boom in a lateral direction, wherein the improvement comprises:

switch means for changing between an automatic mode and a manual mode;

automatic target stop position control means for (a) storing a target stop signal from said position detecting means when said switch means is changed from the manual mode to the automatic mode, said target stop signal being representative of a target stop position of the boom, (b) controlling a pivotal movement of the boom so as to move the boom to the target stop position and stop the boom at the target stop when ($b_1$) the boom is positioned away from the target stop position and ($b_2$) said control lever is moved away from the neutral region in a direction opposite to the direction in which the boom is positioned away from the target stop position and (c) reading a positional signal from said position detecting means during movement of the boom to the target stop position;

manual control means for controlling a pivotal movement of the boom in response to a signal from said pivotal movement instructing means while said switch means is in the manual mode or while said control lever is operated other than as specified in ($b_1$) and ($b_2$) above; and means for changing from the automatic mode to the manual mode when the boom is positioned away from the target stop position and said control lever is moved away from the neutral region in a direction which corresponds to the direction in which the boom is positioned away from the target stop position.

2. A pivotal movement control device for a boom-equipped working machine according to claim 1, wherein said automatic target position stop control means releases the automatic mode when said boom is in the automatic stop position at the time said control lever is returned to the neutral region in the automatic mode.

3. A pivotal movement control device for a boom-equipped working machine according to claim 1, wherein the automatic target position stop control means continues the automatic mode when said boom is in a position other than the automatic stop position at the time said control lever is returned to the neutral region in the automatic mode.

4. A pivotal movement control device for a boom-equipped working machine according to claim 1, wherein said manual control means compares a target speed applied from said pivotal movement instructing means with a pivotally moving angular speed applied from said position detecting means and pivotally moves said boom according to the target speed.

5. A pivotal movement control device for a boom-equipped working machine according to claim 1, further including automatic return control means for automatically returning said boom to the target stop position when said boom exceeds the target stop position under the control of the automatic mode.

6. A pivotal movement control device for a boom-equipped working machine according to claim 1, wherein said pivotal movement instructing means and said position detecting means comprise potentiometers.

7. A pivotal movement control device for a boom-equipped working machine comprising (1) a control lever which is movable between inclined positions on either side of a neutral region, (2) pivotal movement instructing means for controlling a pivotal movement of a boom in response to an inclined position of said control lever and (3) position detecting means for detecting the pivotal position of the boom in a lateral direction, wherein the improvement comprises:

speed reducing region discriminating means for determining, based on a signal from said position detecting means, whether said boom is positioned in speed reducing regions in the vicinity of lateral terminus points of boom movement as the boom is moved to the lateral terminus points; and speed instruction means for generating a speed reducing instruction when a pivotally moving speed of the boom is greater than an instructed speed reducing speed.

8. A pivotal movement control device for a boom-equipped working machine according to claim 7, wherein said pivotal movement instructing means and said position detecting means comprise potentiometers.

9. A pivotal movement control device for a boom-equipped working machine according to claim 7, further including speed means for determining the pivotally moving speed of said boom based on a signal from said position detecting means and applying the pivotally moving speed determined by said speed discriminating means to said speed instruction means.

10. A pivotal movement control device for a boom-equipped working machine according to claim 7, wherein said speed instruction means includes an instructed reducing speed setting means for setting an instructed reducing speed.

11. A pivotal movement control device for a boom-equipped working machine according to claim 7, wherein said speed instruction means compares the present pivotally moving speed of said boom with an instructed reducing speed and generates a speed keeping instruction when the pivotally moving speed is equal to or less than the instructed reducing speed and generates a speed reducing instruction to reduce the speed to a given speed when the pivotally moving speed is greater than the instructed reducing speed.

12. A pivotal movement control device for a boom-equipped working machine comprising (1) a pivotal base for supporting a boom, said pivotal base being movable in a lateral direction, (2) a position detecting means, including a detecting lever, for detecting a moved position of said pivotal base, and (3) control means for (a) storing a target stop position signal from said position detecting means, (b) stopping pivotal movement of said pivotal base at a target stop position and (c) reading a signal from said position detecting means to detect the position of said pivotal base during pivotal movement, wherein the improvement comprises:

said position detecting means disposed on one of said pivotal base and a fixed member;

a control lever disposed on the other of said pivotal base and the fixed member for operating said detecting lever of said position detecting means; and a spring urging said detecting lever and said control lever into engagement at all times.

13. A pivotal movement control device for a boom-equipped working machine according to claim 12, wherein said position detecting means is disposed on the side of said pivotal base.

14. A pivotal movement control device for a boom-equipped working machine according to claim 12, wherein an engaging pin is disposed on one of said detecting lever and said control lever and an engaging recess is provided in the other of said detecting lever and said control lever, said engaging pin being disposed within said engaging recess to enable both said levers to be relatively turned and said spring urging said engaging pin into engagement with a side of said engaging recess at all times.

15. A pivotal movement control device for a boom-equipped working machine according to claim 12 or 14, wherein said position detecting means comprises a potentiometer including a pivotal shaft and said pivotal shaft is provided with said detecting lever.

16. A pivotal movement control device for a boom-equipped working machine according to claim 15, wherein said spring is incorporated in said potentiometer.

17. A pivotal movement control device for a boom-equipped working machine according to claim 1, 7 or 12, further including a potentiometer for developing a control signal, upper limit value setting means and lower limit value setting means for setting an upper limit value and a lower limit value of the control signal, and upper limit value discriminating means and lower limit value discriminating means for comparing said control signal from said potentiometer with the upper and lower limit values and outputting an abnormal signal when said control signal is beyond the compass of the upper and lower limit values of the control signal.

18. A pivotal movement control device for a boom-equipped working machine according to claim 17, wherein an alarm means driven by the abnormal signal is provided.

* * * * *